US006438900B1

(12) United States Patent
Page

(10) Patent No.: US 6,438,900 B1
(45) Date of Patent: Aug. 27, 2002

(54) STORAGE CHAMBER

(76) Inventor: George Page, 421 Lower Broughton Road., The Cliff, Salford, Manchester M7 2EZ (GB)

( * ) Notice: Subject to any disclaimer, the term of this patent is extended or adjusted under 35 U.S.C. 154(b) by 0 days.

(21) Appl. No.: 09/613,677

(22) Filed: Jul. 11, 2000

Related U.S. Application Data

(63) Continuation-in-part of application No. 09/023,141, filed on Feb. 12, 1998, now Pat. No. 6,119,408.

(51) Int. Cl.[7] ..... E04H 15/22
(52) U.S. Cl. ..... 52/2.23; 52/2.16
(58) Field of Search ..... 52/2.11, 2.16, 52/2.17, 2.22, 2.23, 2.24

(56) References Cited

U.S. PATENT DOCUMENTS

| | | | | |
|---|---|---|---|---|
| 4,024,679 A | | 5/1977 | Rain et al. | |
| 4,452,230 A | | 6/1984 | Nelson | |
| 4,567,696 A | | 2/1986 | Malet | |
| 4,637,176 A | | 1/1987 | Acock, Jr. | |
| 4,974,829 A | * | 12/1990 | Gamow et al. | 52/2.17 |
| 5,058,330 A | | 10/1991 | Chow | |
| 5,487,400 A | | 1/1996 | Dawkins | |
| 5,566,512 A | | 10/1996 | Page | |

* cited by examiner

*Primary Examiner*—Michael Safavi
(74) *Attorney, Agent, or Firm*—Michael Best & Friedrich LLP

(57) ABSTRACT

Apparatus primarily for the storage of a motor vehicle comprises a base sheet, an inner cover sheet defining in combination with the base sheet a storage chamber and an outer cover sheet substantially wholly overlying the inner cover sheet. The inner and outer cover sheets are joined together around their peripheral edges and are at least partially releasable from the base sheet, so as to give access to the interior of the storage chamber. At least one fan assembly is provided to drive air from the external ambient into the storage chamber so as to inflate it and air is allowed slowly to leak out of that chamber, into the space between the inner and outer cover sheets and, and then to the external ambient. In this way, the space between the inner and outer cover sheets is inflated by air bleeding from the storage chamber into that space.

28 Claims, 7 Drawing Sheets

STORAGE CHAMBER

CROSS-REFERENCE TO RELATED CASES

This application is a continuation-in-part of U.S. patent application Ser. No. 09/023,141, filed Feb. 12, 1998 now U.S. Pat. No. 6,119,408.

BACKGROUND TO THE INVENTION a) Field of the Invention

This invention relates to containing apparatus for the storage of one or more products. In particular, this invention concerns such apparatus which is inflatable to define a storage chamber within which the products may be stored. Though such products may take a variety of different forms, the invention is particularly—but not exclusively—concerned with the storage of motor vehicles such as vintage cars, classic motor cycles and so on.

b) Description of the Prior Art

In my prior U.S. Pat. No. 5,566,512 I have described and claimed an inflatable storage chamber also intended for use with motor vehicles but which can be used for the storage of other products as well. That storage chamber comprises a base sheet, a cover sheet releasably connected to the base sheet, and a fan arrangement which blows air into the chamber in order to inflate that chamber, once a vehicle has been positioned on the base sheet and the cover sheet connected therearound. By controlling the flow of air through the chamber, it is found that the vehicle is stored in an excellent environment, protected against the harmful effects of moisture, dust, dirt and so on.

The storage chamber of my prior U.S. Pat. No. 5,566,512 is really only suitable for use within some other building, such as a garage. If the chamber is used out-of-doors, there are likely to be significant problems resulting from condensation within the chamber. Drops are likely to form on the inner surface of the cover sheet which then fall on the stored vehicle and this can give rise to damaged paint-work. Also, the plastics materials such as polyethylene from which the storage chamber of my prior patent are made are degraded by the UV rays in sunlight and the cover sheet thus has a relatively short life.

In U.S. Pat. No. 4,567,696 (Malet) there is described an inflatable cover for a sports ground but no enclosed chamber is taught in that document, suitable for enclosing in a controlled environment an object such as a motor vehicle.

SUMMARY OF THE INVENTION

It is a principal object of the present invention to reduce the problems associated with the use out-of-doors of the storage chamber of my prior U.S. Pat. No. 5,566,512.

According to the present invention, there is provided containing apparatus suitable for the storage of a motor vehicle, comprising:

a substantially rectangular base sheet having four side edges;

an inner cover sheet having a peripheral edge connected to the side edges of the base sheet so as to define in combination therewith a storage chamber;

a releasable fastener connecting at least part of the peripheral edge of the cover sheet to the side edges of the base sheet so that the inner cover sheet may be at least partially disconnected from and re-attached to the base sheet so as to give access to the interior of the storage chamber;

an outer cover sheet of substantially the same shape as the inner cover sheet and having a peripheral edge margin connected to the inner cover sheet adjacent the peripheral edge thereof so that the outer cover sheet substantially wholly overlies the inner cover sheet with a space therebetween, the outer cover sheet having a coating substantially resistant to the transmission of UV radiation;

a fan arranged to drive air from the external ambient into the storage chamber defined by the base sheet and the inner cover sheet, so as thereby to inflate the storage chamber;

a first air leakage controller that controls the leakage of air from the storage chamber to said space between the inner and outer cover sheets so as to inflate said space; and a second air leakage controller that controls the leakage of air from said space to the external ambient whereby there will be a flow of air through the storage chamber.

The storage chamber is defined by a base sheet together with a cover sheet itself comprising inner and outer cover sheets which substantially wholly overlie each other, but with a space therebetween so as to permit air under pressure to be supplied thereto and thus to inflate that space and separate the inner and outer cover sheets. By providing a storage chamber with a double skinned cover sheet, and arranging for there to be air flow through the chamber and then through the space between the inner and outer cover sheets, problems associated with condensation can be essentially wholly eliminated. This allows the storage chamber to be used out-of-doors, without any significant probability of condensation droplets forming internally on the inner cover sheet, and then falling on a stored motor vehicle and damaging the paint-work.

BRIEF DESCRIPTION OF THE DRAWINGS

In order that the invention may better be understood, it will now be described in greater detail, with reference to preferred arrangements thereof. Moreover three specific embodiments of storage apparatus of this invention will also be described by way of example, reference being made to the accompanying drawings, in which.

DESCRIPTION OF THE PREFERRED EMBODIMENTS

Figure 1:
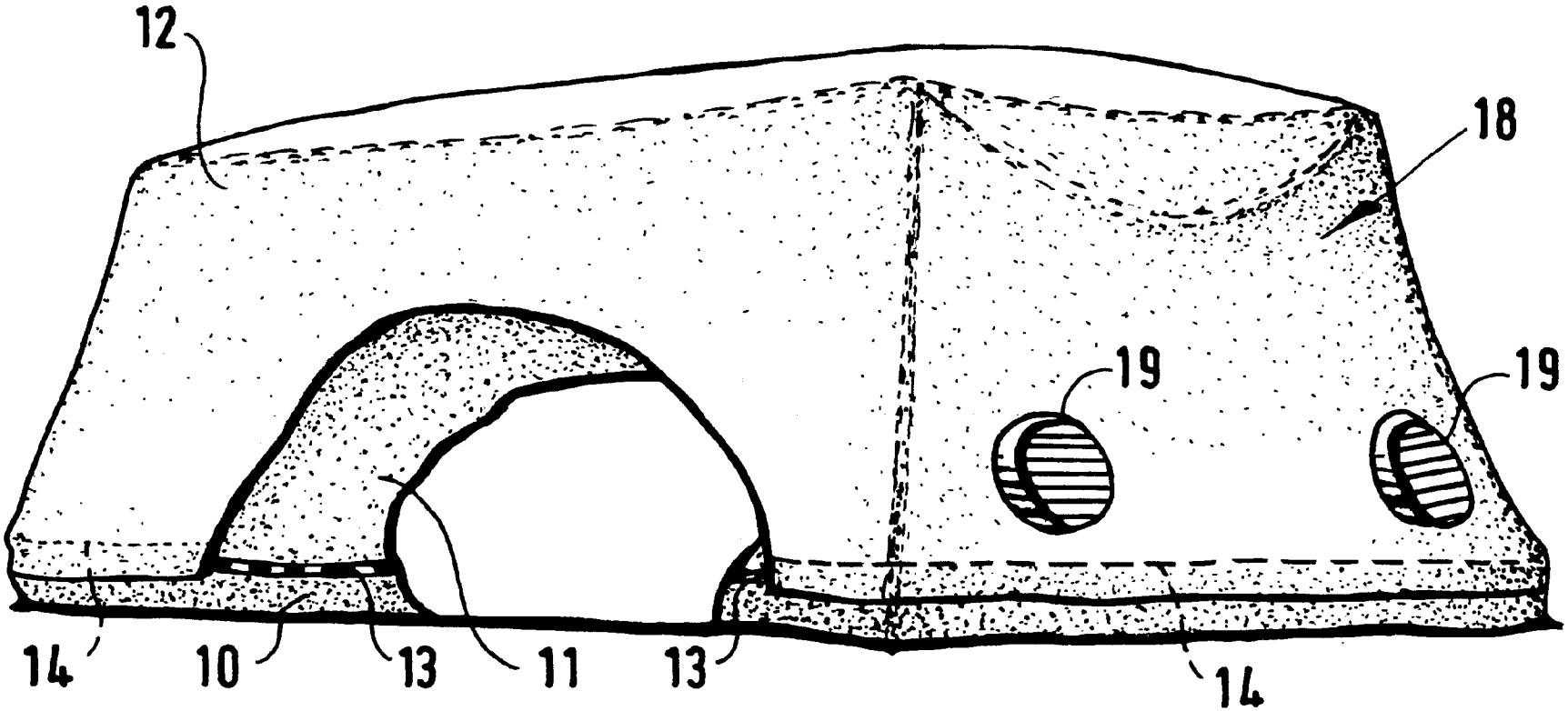
FIG. 1 is a general perspective view of the apparatus, with parts partially cut away for clarity.

In a preferred form of the apparatus of this invention, air is supplied to said space between the inner and outer cover sheets from the storage chamber by bleeding through a vent provided in the inner cover sheet, so as to inflate that space and separate the cover sheets. In this case, the first air leakage controller may be an elongate vent provided in the inner cover sheet, to extend over a part thereof which is spaced from but overlies the basic sheet. The vent may be made adjustable in order that the air flow rate may be controlled to some suitable value to minimise power consumption by the fan and yet to be high enough to prevent the formation of condensation. Alternatively, or possibly in addition, the inner cover sheet may be air-permeable, at least over a part of its area, whereby the air flow between the storage chamber and the space between the inner and outer cover sheets may take place by permeation of the air through the inner cover sheet.

As with the cover sheet of the storage chamber described in my U.S. Pat. No. 5,566,512, the inner and outer cover sheets may be releasably attached to the base sheet around the whole of the periphery of the base sheet. Alternatively, the inner and outer cover sheets could be permanently attached to the base sheet around one, two or even three sides of the base sheet, so long as when the releasable edges are freed from the base sheet, there is still adequate access to the interior of the chamber for the article to be stored within the chamber. In the case of apparatus intended for the storage of a motor vehicle, it is convenient for both the inner and outer cover sheets to be together wholly removable from the base sheet to permit the vehicle to be driven on to the base sheet, whereafter the cover sheet may be thrown over the vehicle and the peripheral edges of the cover sheet then secured to the edges of the base sheet, all the way around the base sheet.

Various forms of releasable fasteners means may be employed for securing the cover sheet to the base sheet. Conveniently, a clasp fastener (such as that conventionally sold under the name Zip fastener) may be used. Other forms of similar fastener, but not using interengageable clasps, may be employed. One such fastener has a continuous pair of ribs running in a parallel manner along the edge of one component and on the other component there is a similar corresponding pair of ribs, a fastener element being slidably engaged with the ribs to urge one pair into engagement with the other pair or to release one pair from the other, dependent upon the direction of movement of the fastener element. Other possibilities would include hook-and-loop type two-part fasteners (such as those sold under the Trade Mark Velcro), lacing systems and so on. Adjustment of the fasteners will allow a degree of control of the air leakage from the storage chamber and so in turn the air flow through that chamber.

One preferred form of containing apparatus has a portion of the outer cover sheet attached to the inner cover sheet so as to define a separate pocket between the inner and outer cover sheets. In this embodiment, the fan is mounted in the inner cover sheet to draw air from said pocket and drive that air into the storage chamber, defined between the base and the inner cover sheet. Preferably, said pocket is formed in a lower region of the outer cover sheet with the lower edge of said pocket being defined by a portion of the peripheral edge margin of the outer cover sheet. In this case, the portion of the peripheral edge margin of the outer cover sheet may be releasably connected to the inner cover sheet, for example by a clasp fastener or a hook-and-loop fastener, whereby said pocket may be opened to the external ambient.

During periods of relatively high atmospheric humidity, this arrangement may be used to give re-circulation of the air within the storage chamber. For this purpose, an adjustable vent may be provided to control the flow of air out of the storage chamber into said pocket, from where the air may be re-circulated into the storage chamber by the fan. For such re-circulation, a dehumidifier may be provided in association with the fan whereby the air driven into the storage chamber is dried to a pre-set humidity level.

In order better to isolate the interior of the chamber from the external ground, it is preferred for the base sheet to have two layers with thermal insulation between the layers.

At least the outer cover sheet is preferably made from a plastics material which has been UV stabilised. For example, the outer sheet may be made from a polyamide sheet, suitably treated for UV stabilisation. Such a sheet may be aluminium coated and impregnated with a silicone, so as to give the material advantageous properties, including protection from up to 99% of solar UV radiation and protection against the build-up of heat due to infra-red light, as well as air, water and moisture impermeability.

Though it would be possible to operate the fan continuously and to control the air flow solely by means of adjustable vents and controlled leakage, for certain conditions it may be advantageous for the fan to be operated with a duty cycle of less than 100%. The operation of the fan could be controlled simply on a time basis, though the fan may be operated under the control of a sensor so as to perform a cyclic action, thus inflating the chamber to a maximum value and then allowing partial collapsing of the chamber before re-inflating the chamber back to the maximum value. The sensor may be arranged to monitor the pressure within the chamber, or perhaps in the space between the inner and outer cover sheets, and to control the operation to the fan dependent upon the sensed pressure. Other possibilities include having a humidity sensor or a temperature sensor and to control the fan dependent upon the sensed humidity or temperature, respectively.

In a preferred form of the invention there is a pair of electric motor driven fans, mounted spaced apart at one end of the storage chamber on the cover sheet, so as to draw air from the external ambient and drive that air directly into the storage chamber. Preferably, each fan is a relatively small unit driven by a low-powered 12 v dc electric motor. Each fan may be mounted in a carrier which is secured to the cover sheet, the carrier including a filter panel and also a one-way valve to prevent air leaking out of the storage chamber when the fan is not operating. Such a valve conveniently comprises a flap valve located over the exit duct of the fan and which may move under gravity or under a spring to a closed position when the fan is not operating. The carrier may also include a drain hole to allow any moisture collecting within the carrier to drain externally of the storage chamber.

In a modified form of fan unit, there is provided a secondary electric motor driven fan mounted on the carrier of the main motor-driven fan. A control arrangement may be provided for the secondary fan selectively to cause operation of that fan dependent upon the conditions prevailing within the chamber and possibly also externally of the apparatus. For example, to increase the air flow through the chamber, the secondary fan may be operated so as also to drive air into the chamber, in parallel with the main fan. Should the external humidity be higher than the humidity within the chamber, then the secondary fan may be turned off so that air flows out of the chamber through the secondary fan, for re-circulation into the chamber by the main fan. To assist this, the main and secondary fans may draw air from a common plenum chamber. A filter may be provided over the external inlet to that plenum chamber.

The power supply for the or each electric motor driven fan may comprise the battery of a vehicle stored within the chamber and in this case a suitable control unit should be provided to prevent the battery voltage falling below some minimum value. The battery may be recharged for example by one or more solar panels, a wind generator or a mains operated charger. Another possibility includes operating the fan motors from the mains supply via a suitable transformer.

The first embodiment of storage chamber will now be described with reference to FIGS. 1 to 6. Referring to those drawings, there is shown an inflatable storage chamber comprising a generally rectangular base sheet 10, an inner cover sheet 11 and an outer cover sheet 12, the inner and outer cover sheets being of substantially the same shape and size with the outer cover sheet overlying the inner cover sheet. The inner cover sheet is releasably secured to the base sheet around its four edges, by means of a two part clasp fastener 13 (such as that kind of fastener sold under the name Zip fastener) extending wholly around the base sheet. Rather than having one long continuous fastener, it may be more convenient for some storage chambers to have four or even more separate fasteners extending along the sides of the base sheet. The outer cover sheet 12 is secured at 14 to the inner cover sheet around the entire periphery of the inner cover sheet, just above the fastener 13. That securing should be effected in a substantially air tight manner though condensation drainage tubes 15 may be provided at intervals along the length of the join, which tubes also allow air to leak out of the space between the two cover sheets.

The base sheet 10 may be relatively stiff or even semi-rigid and though not shown in the drawings, may be made from upper and lower impermeable sheets together with a layer of thermal insulating material between those sheets. The inner cover sheet 11 may be of an air-permeable material such as a micro-porous plastic sheet. The outer cover sheet should be air and water impermeable and typically is a polyamide sheet carrying on its inner surface a coating of aluminium and on its outer surface a silicone coating. The silicone coating renders the sheet wholly waterproof and allows easy cleaning, whereas the aluminium coating makes the sheet substantially opaque and shields any object located within the inner cover sheet from harmful solar UV radiation. In addition, the coating will reflect infra-red light and so assist in preventing a build-up in temperature within the chamber, during hours of daylight.

Figure 2:
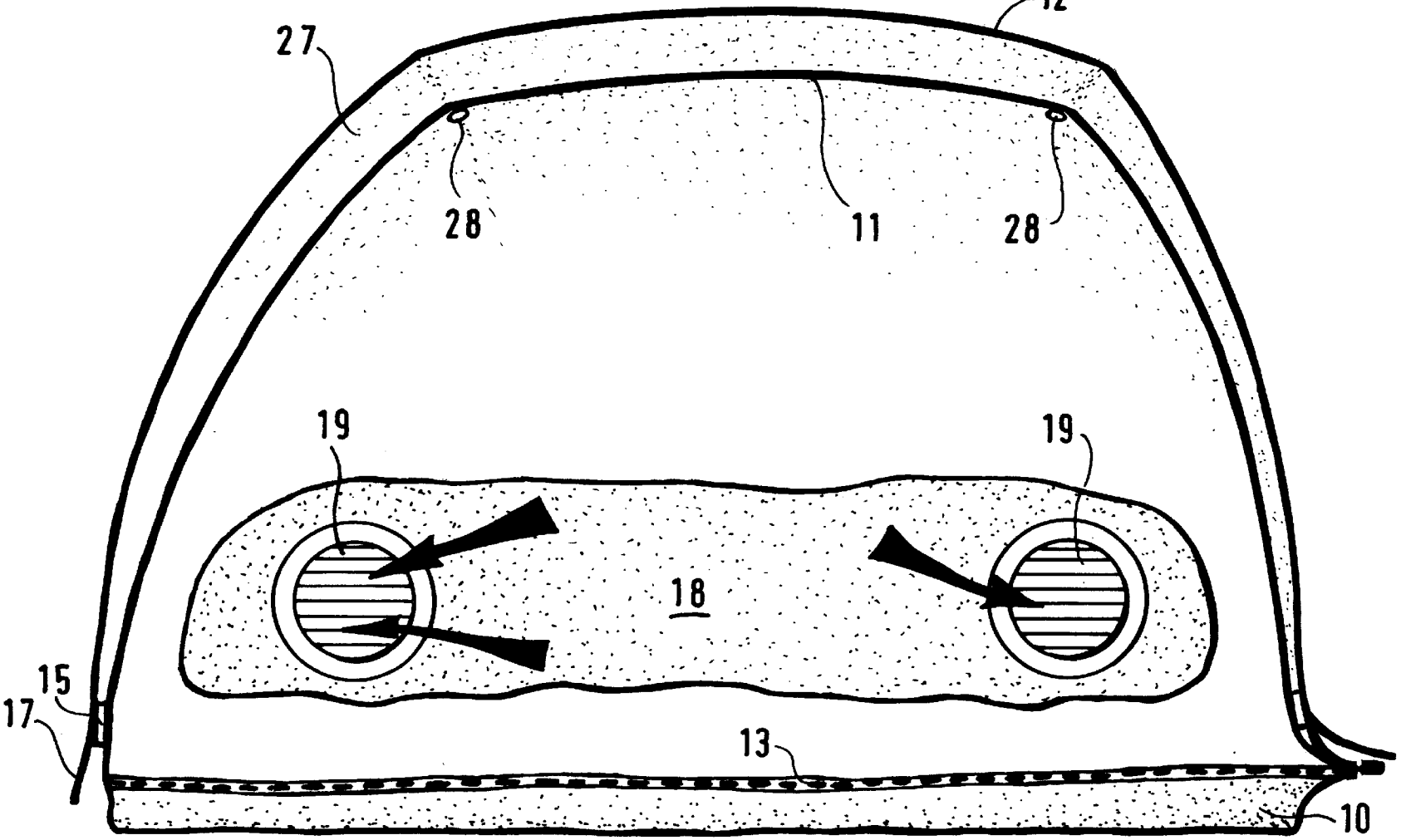
FIG. 2 is a vertical section transversely through the apparatus of FIG. 1 but with the fan units shown in end elevation.
Figure 3:
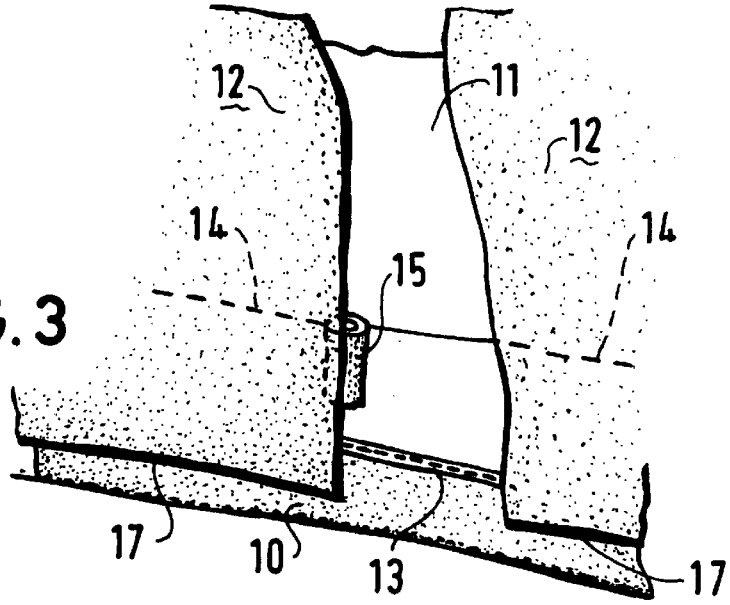
FIG. 3 is a detailed view on the join between the cover sheet and the base sheet.

Though not shown in FIGS. 1 to 3, an additional fastener may be provided between the free edge 17 of the outer sheet 12 and the base sheet 10, so as to permit joining of the outer sheet to the base sheet.

Figure 4:
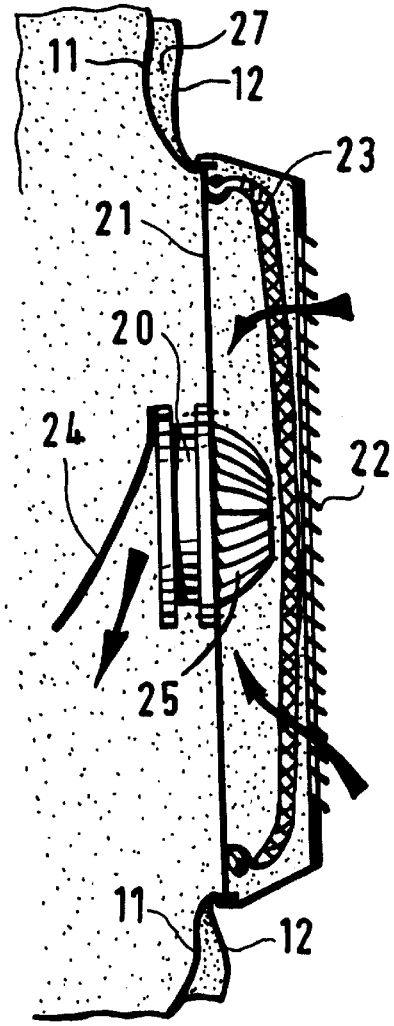
FIG. 4 is a vertical section through one embodiment of fan unit.

Mounted in end wall 18 of the inner and outer cover sheets 11 and 12 is a pair of electric motor driven fan units 19, each of the same construction. One such fan unit is shown in FIG. 4. This has an electric motor 20 mounted on a carrier 21 attached around an opening through the inner and outer cover sheets 11 and 12. The carrier has a louvered cap 22, a foam air filter 23 being mounted between the motor 20 and the cap 22. The motor 20 drives a fan impeller (not shown) to draw air through the unit in the direction of the arrows, a flap valve 24 being mounted on the exit duct which flap valve opens during operation of the motor but which closes when the motor is not operated, to prevent back-leakage of air. A finger guard 25 may be mounted over the inlet side of the duct within which the fan impeller rotates.

Figure 5:
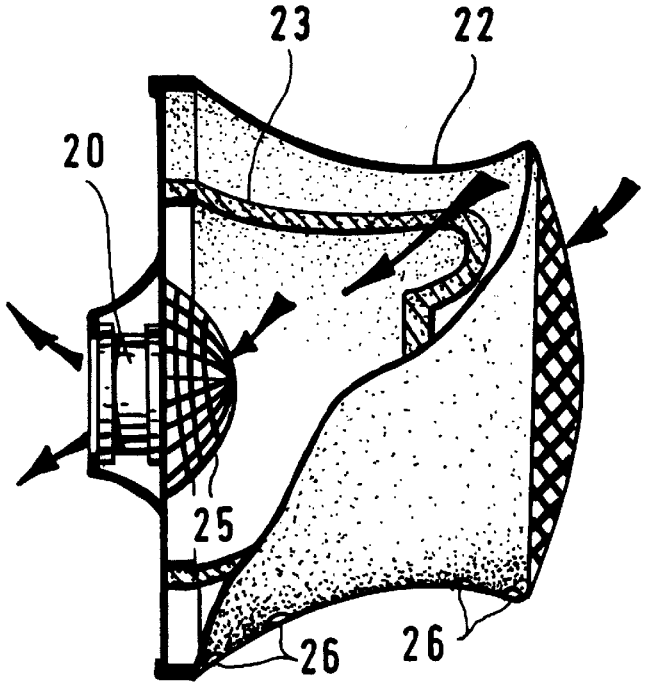
FIG. 5 is a vertical section through an alternative embodiment of fan unit.

FIG. 5 shows a similar fan unit, but having a significantly larger air filter, as well as better shielding from atmospheric precipitation. In this arrangement, like parts are given like numbers and will not be described again here. Water drain holes 26 are provided in the bottom of the cap 22. Similar holes may of course be provided in the arrangement of FIG. 4, if required.

The motors of the two fan units are connected in parallel to a power supply unit, for the delivery of a 12 v dc supply to the fan motors when the fans are to inflate the chamber. The power supply unit may comprise a transformer for the 240 v (or other voltage) domestic mains supply or may be arranged to supply power from the battery of a vehicle stored within the apparatus. The power supply unit may include a sensor for monitoring one or more of the air pressure, humidity and temperature within the chamber and to control the operation of the fans dependent thereon.

In use, the two cover sheets are removed from the base sheet and a motor vehicle is driven on to the base sheet. The cover sheets are thrown over the vehicle and then the inner cover sheet 11 is secured to the base sheet, using the fastener 13. If a further fastener is provided around the outer cover sheet 12, then that fastener is also secured to the base sheet 10. The fan units are then operated to draw air from the external ambient and drive that air into the volume between the base sheet and the inner cover sheet 11, so that the chamber inflates and the inner cover sheet is wholly free of the vehicle stored within the chamber defined by the base sheet and inner cover sheet. The air blown into the chamber permeates through the inner cover sheet into the space 27 between the inner and outer cover sheets so as also to inflate that space as shown in FIG. 2. From there, the air leaks out of the drain tubes 15, back to the external ambient. The double-sealed construction, if used around the free edge of the outer cover sheet 12, serves to restrict leakage of air out of the chamber and also to give better control of the air flow.

Air holes 28 may be provided in the inner cover sheet, so as to increase the air flow from the chamber to the space 27, to ensure complete inflation of that space and also increase air flow through the chamber. The air holes may be made adjustable (for example for providing flaps secured by hook-and-loop fasteners) or an adjustable vent may be mounted over each air hole. If a greater air flow is required through the chamber, for example to dry a vehicle put into the chamber when wet, the Zip fastener 13 may be released for a short distance, so allowing increased leakage directly from the chamber. Alternatively, adjustable vents (not shown) may be provided from the chamber direct to the external ambient and in this case such vents should be provided in the wall of the cover sheet opposed to the wall carrying the fan units.

Figure 6:
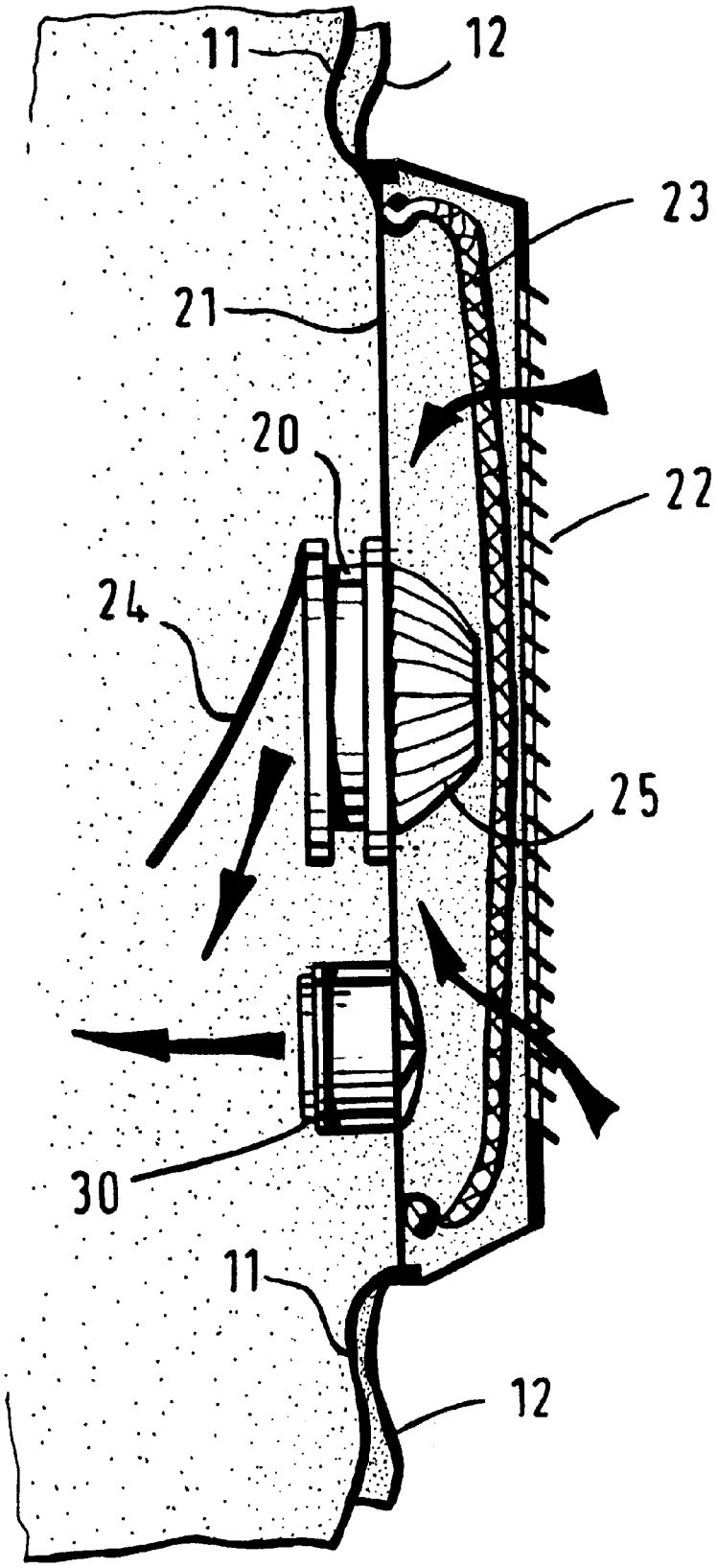
FIG. 6 is a view similar to that of FIG. 4, but of a modified form of fan unit.

FIG. 6 shows a modified form of the fan unit shown in FIG. 4. Here, a secondary electric motor-driven fan 30 is mounted on the carrier 21, to draw air (when operated) from the space between the carrier 21 and filter 23. The operation of the secondary fan may be under the control of internal and external humidity sensors. In the event that the humidity within the chamber is greater than the external humidity (for example if a wet vehicle has been placed within the chamber) then both main and secondary fans may be operated together, to increase the air flow through the chamber and so to assist drying of the vehicle in the chamber. On the other hand, if the humidity externally is greater than that within the chamber, the secondary fan 30 may be turned off so that air will flow in the reverse direction through the secondary fan, back into the space between carrier 21 and filter 23. From there, the air will be re-circulated into the chamber, so minimising the amount of relatively wet air driven into the chamber from the exterior.

Figure 7:
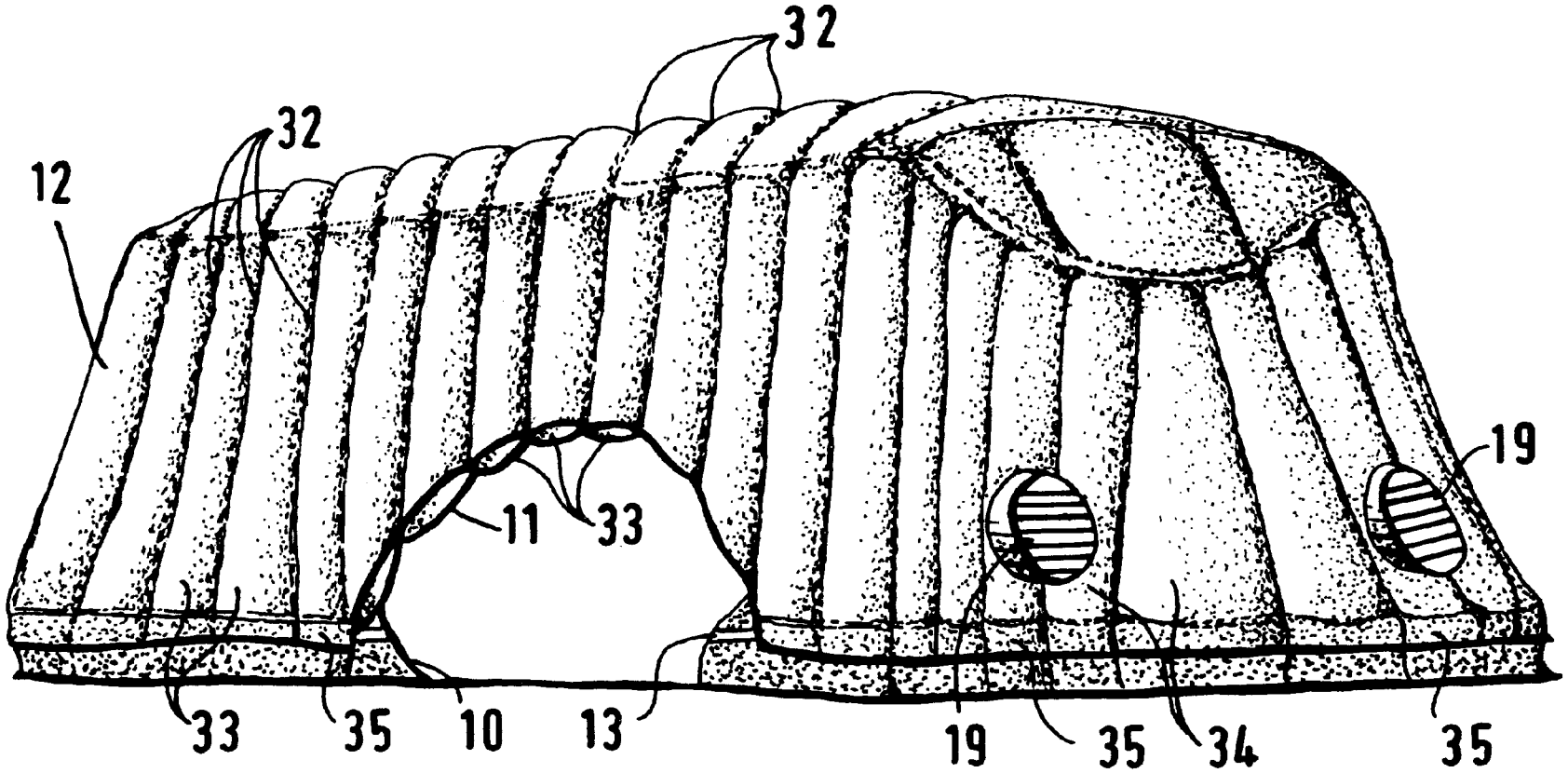
FIG. 7 is a view similar to that of FIG. 1, but of a further embodiment of this invention.

FIG. 7 shows a second embodiment of storage chamber generally similar to that of FIG. 1 and like parts are given like reference characters; these parts will not be described in detail again here. The storage chamber of FIG. 7 differs from that of FIG. 1 in that there is a plurality of spaced, substantially parallel seams 32 joining together the inner cover sheet 11 and the outer cover sheet 12, so forming a multiplicity of elongate tubular pockets 33 extending up one side of the cover sheet, over the top and down the other side. Furthermore, similar seams are provided on the end panels of the inner and outer cover sheets, so forming further elongate tubular pockets 34 on those end panels. In the illustrated embodiment, a passageway 35 extends around the cover sheets adjacent their lower edges, interconnecting all of the tubular pockets 33 and 34, which passageway is provided with an inlet valve to permit the inflation of all of the pockets, simultaneously. With this embodiment, it would, as an alternative, be possible to provide no communication between the space defined between the inner and outer cover sheets and the principal volume of the storage chamber, defined between the inner cover sheet and the base sheet. Thus, the pockets may be inflated separately from the inflation of the main chamber and,.when the pockets are inflated, the structure will be self-supporting even without the inflation of the main chamber.

In the embodiment of FIG. 7, means are provided to allow the leakage of air from the main chamber, such as one or more adjustable vents (not shown) provided at the opposite end of the chamber from the fan units 19, to permit a through-flow of air through that main chamber, during operation of those fan units. In other respects, the embodiment of FIG. 7 is similar to that of FIG. 1.

Figure 8:
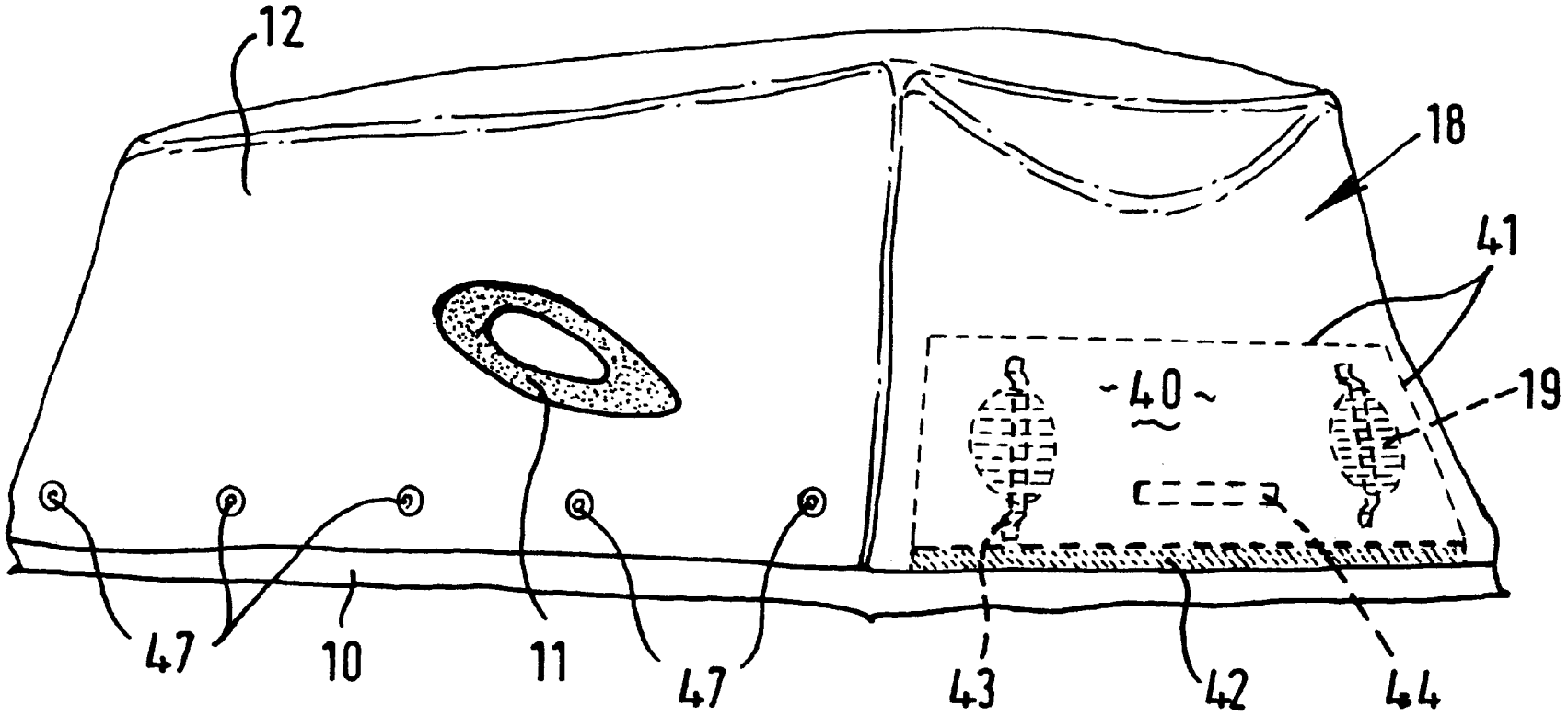
FIG. 8 is a view similar to that of FIG. 1, but of a third embodiment of this invention.
Figure 9:
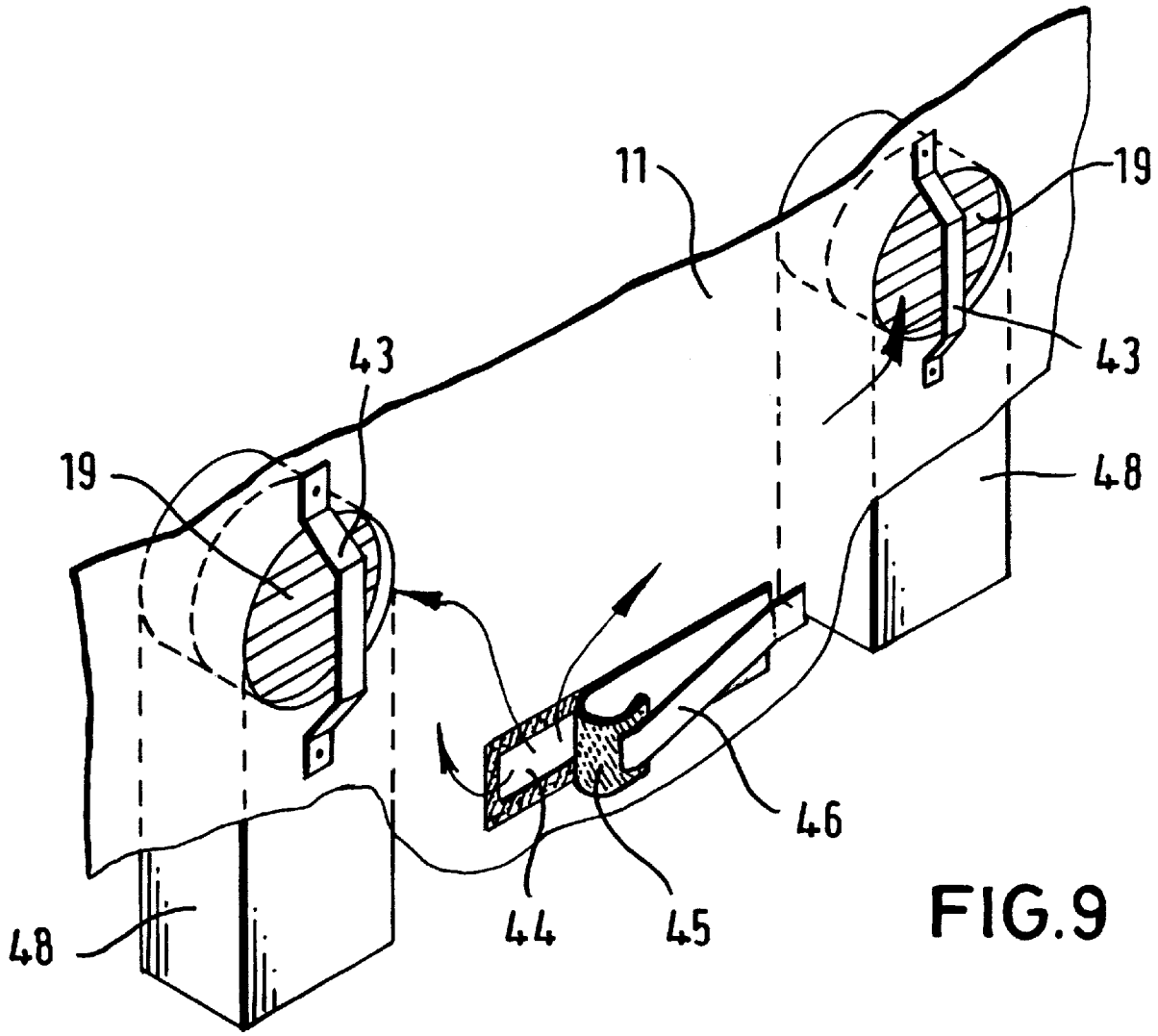
FIG. 9 is a detail view of part of the third embodiment.

The embodiment of FIGS. 8 and 9 is generally similar to that of FIG. 1 and like parts are again given like reference characters; these parts will not be described again here. The storage chamber of FIG. 8 differs from that of FIG. 1 in that the arrangement at the end wall 18 is modified somewhat. An area 40 of the outer cover sheet 12 is defined by lines of stitching 41 around the three edges of that area, which stitching attaches the outer cover sheet 12 to the inner cover sheet 11 so as to form a separate pocket between the inner and outer cover sheets. The lower edge 42 of the outer cover sheet in the region of this pocket is provided with a releasable fastener to secure that lower edge to the inner cover sheet 11, which fastener preferably is of the hook-and-loop type, referred to above. The motor driven fan units 19 are mounted solely in the inner cover sheet 11, so that the fans draw the air to be driven into the storage chamber solely from within the pocket. To prevent the outer cover sheet overlying those fans from sealing the inlet apertures, suitable guards 43 (FIG. 9) are provided over the fans, to hold the outer cover sheet 12 away from the inlet louvers of the fans.

Also shown in FIGS. 8 and 9 is an adjustable re-circulating air vent 44 provided through the inner cover sheet and communicating with the pocket. When there is high external humidity, the adjustable vent 44 may be opened by peeling back a flap 45 (FIG. 9) to a required extent. The flap 45 is releasably secured around the vent opening by means of mating hook-and-loop fasteners, but may be held in the required open position by means of a tab 46 extending from one end of the vent and exerting a spring force on the peeled-back part of the flap 45.

Once the vent has been opened to the required extent, the lower edge 42 of the pocket is sealed to the inner cover sheet by joining the fastener extending along that edge. Then, the air driven into the storage chamber will be mostly re-circulated air, entering the pocket through the opened adjustable vent 44 and driven back into the chamber by the fans. At other times, when the atmospheric humidity is lower, the pocket may be opened by releasing the fastener along edge 42 and closing the adjustable vent 44, so that the storage chamber operates in the same manner as has been described above with reference to FIG. 1.

Also shown in FIG. 8 are air leakage holes 47 which are provided around the lower edge of the outer cover sheet 12, and which serve to allow air to leak to atmosphere from the space between the two cover sheets 11 and 12. Further, the holes 47 allow any condensation collecting within that space to drain away.

With the arrangement of FIG. 8, a single vent is preferably provided to permit air to leak out of the storage chamber to the space between the inner and outer cover sheets 11 and 12, ignoring the adjustable vent 44 leading to the pocket. That single vent extends along the length of the storage chamber, through the inner cover sheet 11 over that part of the inner cover sheet which overlies the base sheet 10. Further, as shown in FIG. 9, a dehumidifier 48 may be associated with each fan 19, so as to dry air driven into the storage chamber by the fan. Such a dehumidifier 48 is mounted within the storage chamber so as to form part of the fan. The dehumidifier may be operated automatically, whenever the humidity of the air drawn by the associated fan exceeds some predetermined value.

It will be appreciated that the arrangement of FIGS. 8 and 9 allows greater flexibility for use of the storage chamber in a wide range of climatic conditions and allows air to be re-circulated or drawn from the external atmosphere, dependent upon the humidity and temperature of the external air. Further, the storage chamber allows the drying of a stored vehicle in a particularly effective manner should that vehicle be placed into the storage chamber when wet. Once dry, the vehicle may be stored in optimum conditions, using only a very small power consumption to achieve that.

I claim:

1. Containing apparatus for the storage of a motor vehicle, comprising:

a substantially rectangular base sheet having four side edges;

an inner cover sheet having a peripheral edge connected to the side edges of the base sheet so as to define in combination therewith a storage chamber;

a releasable fastener connecting at least part of the peripheral edge of the cover sheet to the side edges of the base sheet so that the inner cover sheet may be at least partially disconnected from and re-attached to the base sheet so as to give access to the interior of the storage chamber;

an outer cover sheet of substantially the same shape as the inner cover sheet and having a peripheral edge margin connected to the inner cover sheet adjacent the peripheral edge thereof so that the outer cover sheet substantially wholly overlies the inner cover sheet with a space therebetween, the outer cover sheet having a coating substantially resistant to the transmission of UV radiation;

a separate pocket having edge margins being defined between the inner and outer cover sheets by joining together the inner and outer cover sheets along said edge margins, an air vent communicating between the external atmosphere and the pocket;

a fan mounted in the inner cover sheet within said pocket and arranged to draw air from said pocket and drive that air into the storage chamber defined by the base sheet and the inner cover sheet, so as thereby to inflate the storage chamber;

a first air leakage controller that controls the leakage of air from the storage chamber to said space between the inner and outer cover sheets so as to inflate said space; and a second air leakage controller that controls the leakage of air from said space to the external ambient whereby there will be a flow of air through the storage chamber.

2. Containing apparatus as claimed in claim 1, wherein the first air leakage controller comprises an air bleed arranged to permit air within the storage chamber to bleed into and inflate said space between the inner and outer cover sheets.

3. Containing apparatus as claimed in claim 2, wherein the first air leakage controller comprises an elongate vent in the inner cover sheet, extending over a part thereof which is spaced from but overlies the base sheet.

4. Containing apparatus as claimed in claim 2, wherein the inner cover sheet is air permeable.

5. Containing apparatus as claimed in claim 1, wherein the inner and outer cover sheets are joined together by a plurality of spaced, substantially parallel seams to define a multiplicity of elongate tubular pockets.

6. Containing apparatus as claimed in claim 5, wherein at least some of said elongate tubular pockets are linked for simultaneous inflation and pressure equalisation.

7. Containing apparatus as claimed in claim 1, wherein the fan comprises at least one electric motor drivingly connected to a fan impeller.

8. Containing apparatus as claimed in claim 1, wherein said separate pocket is formed in a lower region of the outer cover sheet with one edge margin of said pocket being defined by a portion of the peripheral edge margin of the outer cover sheet.

9. Containing apparatus as claimed in claim 8, wherein said air vent is defined by said portion of the peripheral edge margin of the outer cover sheet, which edge margin is releasably connected to the inner cover sheet whereby said pocket may be opened to the external ambient.

10. Containing apparatus as claimed in claim 1, wherein an adjustable further vent is provided to control the flow of air out of the storage chamber into said pocket.

11. Containing apparatus as claimed in claim 10, wherein the second air leakage controller includes a series of relatively small holes formed through the outer cover sheet adjacent the peripheral edge region of the outer cover sheet, whereby air leaks from said space to the ambient through said holes.

12. Containing apparatus as claimed in claim 1, wherein the second air leakage controller includes a series of relatively small holes formed through the outer cover sheet adjacent the peripheral edge region of the outer cover sheet, whereby air leaks from said space to the ambient through said holes.

13. Containing apparatus as claimed in claim 1, wherein the outer cover sheet has a coating of aluminium.

14. Containing apparatus as claimed in claim 1, wherein the outer cover sheet has an external coating of a silicone material.

15. Containing apparatus as claimed in claim 1, wherein the inner and outer cover sheets are wholly releasable from the base sheet.

16. Containing apparatus as claimed in claim 12, wherein the releasable fastener has a first part and a second part, wherein said first part of the releasable fastener extends around the base sheet and is engageable with the second part of the fastener, said second part extending around the peripheral edge of the inner cover sheet.

17. Containing apparatus as claimed in claim 1, wherein there is a further releasable fastener having a first part and a second part, wherein said first part of the further releasable fastener extends around the base sheet and is engageable with the second part of the fastener, the second part extending around the peripheral edge margin of the outer cover sheet.

18. Containing apparatus as claimed in claim 1, further comprising a cyclic controller that cyclically operates the fan.

19. Containing apparatus as claimed in claim 18, wherein the cyclic operation of the fan is under the control of at least one of air pressure, temperature and humidity within the storage chamber.

20. Containing apparatus as claimed in claim 1, further comprising a secondary fan adjacent and in parallel with the first fan, which secondary fan is arranged when operated to drive air into the storage chamber.

21. Containing apparatus as claimed in claim 20, further comprising a humidity detector that controls operation of the secondary fan by comparing the relative humidities in the chamber and externally of the apparatus.

22. Containing apparatus for the storage of a motor vehicle, comprising:

a substantially rectangular base sheet having four side edges;

an inner cover sheet having a peripheral edge connected to the side edges of the base sheet so as to define in combination therewith a storage chamber;

a releasable fastener connecting at least part of the peripheral edge of the cover sheet to the side edges of the base sheet so that the inner cover sheet may be at least partially disconnected from and re-attached to the base sheet so as to give access to the interior of the storage chamber;

an outer cover sheet of substantially the same shape as the inner cover sheet and having a peripheral edge margin connected to the inner cover sheet adjacent the peripheral edge thereof so that the outer cover sheet substantially wholly overlies the inner cover sheet with a space therebetween, the outer cover sheet having a coating substantially resistant to the transmission of UV radiation;

a primary fan arranged to drive air from the external ambient into the storage chamber defined by the base sheet and the inner cover sheet, so as thereby to inflate the storage chamber;

a secondary fan adjacent and in parallel with the first fan, which secondary fan is arranged when operated to drive air into the storage chamber;

a controller for the secondary fan which controller includes a humidity detector and controls operation of the secondary fan by comparing the relative humidities in the chamber and externally of the apparatus;

a first air leakage controller that controls the leakage of air from the storage chamber to said space between the inner and outer cover sheets so as to inflate said space; and a second air leakage controller that controls the leakage of air from said space to the external ambient whereby there will be a flow of air through the storage chamber.

23. Containing apparatus as claimed in claim 22, wherein the first air leakage controller comprises an air bleed arranged to permit air within the storage chamber to bleed into and inflate said space between the inner and outer cover sheets.

24. Containing apparatus as claimed in claim 23, wherein the first air leakage controller comprises an elongate vent in the inner cover sheet, extending over a part thereof which is spaced from but overlies the base sheet.

25. Containing apparatus as claimed in claim 22, wherein said primary and secondary fans are disposed within a pocket having edge margins and which is defined between the inner and outer cover sheets by joining together the inner and outer cover sheets along said edge margins, the primary and secondary fans being mounted in the inner cover sheet to draw air from said pocket and drive that air into the storage chamber.

26. Containing apparatus as claimed in claim 25, wherein said pocket is formed in a lower region of the outer cover sheet with one edge margin of said pocket being defined by a portion of the peripheral edge margin of the outer cover sheet.

27. Containing apparatus as claimed in claim 26, wherein said portion of the peripheral edge margin of the outer cover sheet is releasably connected to the inner cover sheet whereby said pocket may be opened to the external ambient.

28. Containing apparatus as claimed in claim 25, wherein an adjustable vent is provided to control the flow of air out of the storage chamber into said pocket.

* * * * *